US007118144B2

(12) United States Patent
Anderson

(10) Patent No.: US 7,118,144 B2
(45) Date of Patent: Oct. 10, 2006

(54) PADLOCK

(76) Inventor: Michael Stuart Anderson, Plot 141, 2nd Road, Chartwell, 2194, Randburg (ZA)

( * ) Notice: Subject to any disclaimer, the term of this patent is extended or adjusted under 35 U.S.C. 154(b) by 0 days.

(21) Appl. No.: 10/519,739

(22) PCT Filed: Jul. 16, 2003

(86) PCT No.: PCT/IB03/02821

§ 371 (c)(1),
(2), (4) Date: Dec. 28, 2004

(87) PCT Pub. No.: WO2004/017280

PCT Pub. Date: Feb. 26, 2004

(65) Prior Publication Data

US 2005/0230981 A1 Oct. 20, 2005

(30) Foreign Application Priority Data

Aug. 16, 2002 (ZA) ..... 02/6585

(51) Int. Cl.
*G09F 3/03* (2006.01)

(52) U.S. Cl. ..... 292/307 R; 292/307 A; 292/328; 292/316; 292/282

(58) Field of Classification Search ..... 292/307 R, 292/328, 316, 319, 318, 323, 307 A, 282; 70/50, 27–29, 41–48
See application file for complete search history.

(56) References Cited

U.S. PATENT DOCUMENTS 3,717,369 A 2/1973 Stoffel et al.
4,733,893 A * 3/1988 Davis et al. ..... 292/320
4,779,911 A * 10/1988 Wu ..... 292/318
4,782,564 A * 11/1988 Sloan ..... 24/704.1
4,909,552 A * 3/1990 Weber et al. ..... 292/320
5,156,029 A * 10/1992 Heald ..... 70/55
5,314,219 A * 5/1994 Georgopoulos et al. .... 292/320
5,522,627 A * 6/1996 Swift ..... 292/319
5,782,513 A * 7/1998 Nazzari ..... 292/319
5,884,949 A * 3/1999 Leon et al. ..... 292/318
6,398,273 B1 * 6/2002 Aichmann ..... 292/323
6,578,887 B1 * 6/2003 Kienzler ..... 292/321
6,749,235 B1 * 6/2004 Crisp ..... 292/317
6,869,113 B1 * 3/2005 Burt ..... 292/307 R
6,918,620 B1 * 7/2005 Crisp ..... 292/317

FOREIGN PATENT DOCUMENTS

GB 2 264 463 A 9/1993
GB 2 364 967 A 2/2002
JP 2000-177753 A 6/2000
WO WO 01/86615 A 11/2001
WO WO 02/16215 2/2002

* cited by examiner

*Primary Examiner*—Brian E. Glessner
*Assistant Examiner*—Mark Williams
(74) *Attorney, Agent, or Firm*—Frommer Lawrence & Haug LLP; Ronald R. Santucci

(57) ABSTRACT

The invention concerns a tamper-evident padlock and padlock combination. The padlock (10) has a moulded plastics lock body (14) which includes an open-ended passage (22) and an opening (26) spaced from the passage. There is also a hasp (16) which has first and second spaced apart legs (32, 34). An end (32.1) of the first leg can be located in the passage through a first end thereof while the end of the second leg can be located simultaneously in the opening. The end of the first leg in the passage can then be engaged by a breakable seal (20) which is inserted into the passage through the opposite end of the passage, in order to lock the hasp relative to the lock body. The padlock combination (12) comprises the padlock (10) and the seal (20) in combination.

10 Claims, 2 Drawing Sheets

PADLOCK

This is a 371 filing of International Patent Application No. PCT/IB2003/002821 filed Jul. 16, 2003 and published on Feb. 26, 2004 under publication number WO 2004/017280 A and claims priority benefits from South African Patent Application No. 2002/6585 filed Aug. 16, 2002.

BACKGROUND TO THE INVENTION

THIS invention relates to a padlock.

A known padlock marketed under the name ENVOSEAL has a lock body of multi-part, moulded plastics construction and a metal hasp which is generally U-shaped. A first leg of the hasp is held captive in the lock body in such a manner that the hasp can pivot and slide relative to the lock body between respective open and closed positions. When the hasp is in a closed position the end of its second leg locates in an opening in the lock body and a transverse hole in the first leg aligns with a transverse hole in the lock body. A frangible plastic seal is clipped to the lock body such that a part of the seal locates in the aligned holes. This prevents pivotal movement of the hasp from the closed to the open position until such time as the seal is broken and removed. Breakage of the seal Indicates that the lock has been tampered with.

Padlocks of this kind are used in many different applications where a tamper-evident seal is required. One example is in airline trolleys used to store duty free goods, alcoholic beverages and the like. Typically, the padlock in such an application is used to lock the door or drawer of the trolley in a closed position.

A drawback of the known padlock described above is that it is expensive to manufacture, partly because individually moulded plastic components have to be assembled about the metal hasp and then connected to one another to hold the hasp leg captive. Another drawback is that the design of the padlock dictates that it must have a fairly substantial thickness. For economy of space and packing airline trolleys have a recess to receive the installed lock but this is often too shallow to accommodate the known lock fully. As a result the lock projects from the trolley and can either present an obstruction or itself be impacted on and possibly damaged.

SUMMARY OF THE INVENTION

According to the invention there is provided a padlock comprising:

a moulded plastics lock body having therein an open-ended passage and an opening spaced from the passage; and a hasp which has first and second spaced apart legs, an end of the first leg being locatable in the passage through a first end thereof and an end of the second leg being locatable simultaneously in the opening, the end of the first leg in the passage being engagable by a breakable seal inserted into the passage through an opposite, second end thereof to lock the hasp relative to the lock body.

Preferably the lock body is of one-piece, moulded plastics construction nad has a thickness of 8 mm or less. The hasp may be attached to the lock body by a cord or the like. Alterantively it may be attached to the lock body, typically by means of a rivet, in a manner allowing sliding and pivotal movement of the hasp relative to the lock body.

Other features of the padlock of the invention are set forth in the accompanying description and the appended claims.

According to another aspect of the invention there is provided a padlock combination comprising the padlock summarised above and a breakable seal having an insertion portion which can be engaged, by movement of the seal through the second end of the passage, with the end of the first leg of the hasp when this end is located in the passage, thereby to lock the hasp relative to the lock body.

Other features of the padlock combination are also set forth in the accompanying description and the appended claims.

BRIEF DESCRIPTION OF THE DRAWINGS

The invention will now be described in more detail, by way of example only, with reference to the accompanying drawings in which.

DESCRIPTION OF PREFERRED EMBODIMENTS

Figure 1:
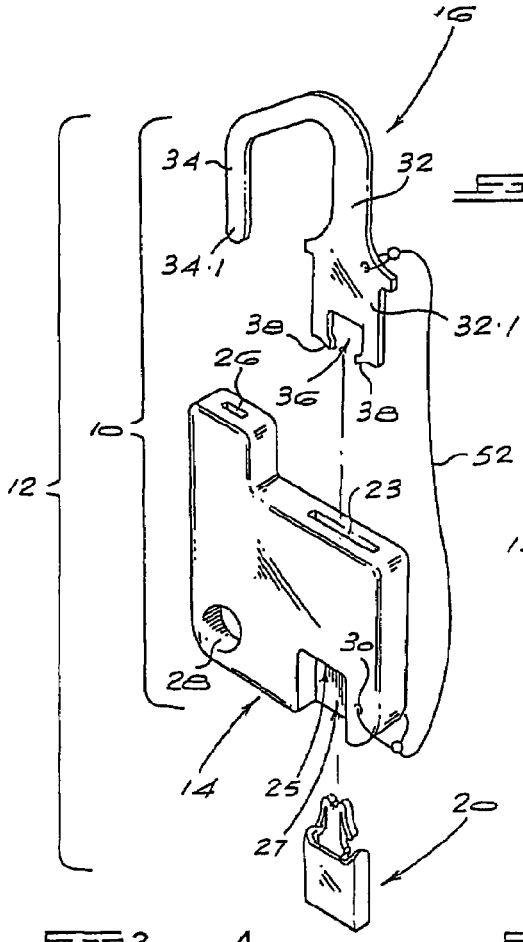
FIG. 1 illustrates a padlock and padlock combination according to a first embodiment of the invention in an unlocked condition.

FIG. 1 illustrates a padlock 10 and a padlock combination 12 according to a first embodiment of the present invention. The padlock 10 consists of a lock body 14 and a hasp 16. The padlock combination 12 consists of the padlock 10 and a seal 20.

The lock body 14 is a one-piece plastics moulding. It has a passage 22 extending through it from one open end 23 to an opposite open end 25. There is a shoulder 24 adjacent the mouth of the passage at the open end 25, which opens into a generally rectangular recess 27. The lock body 14 also has a blind opening 26 spaced from and parallel to the passage. Relatively large and relatively small holes 28 and 30 respectively extend tranversely through the lock body The hasp 16 is of 2 mm thick flat mild steel and has the shape seen in FIG. 1. It is generally of U-shape with first and second legs 32 and 34 respectively, the leg 32 being somewhat longer than the leg 32. The end 34.1 of the leg 34 is dimensioned to be a snug slide fit in the blind opening 26. The end 32.1 of the leg 32 is enlarged and is a slide fit in the passage 22. It includes shoulders 32.2 and is formed with a cavity 36 which is undercut by virtue of opposing, re-entrant, inclined tabs 38. The tabs 38 have inclined outer surfaces 38.1 and similarly inclined inner surfaces 38.2.

The seal 20, which, together with the padlock 10, makes up the padlock combination 12 of the invention, is made as a one-piece plastics moulding. It includes a tab portion 20.1 from which an insertion portion 20.2 projects. The insertion portion has a central stem 20.3 and resilient arms 20.4 which project rearwardly from the end of the stem.

Figure 2:
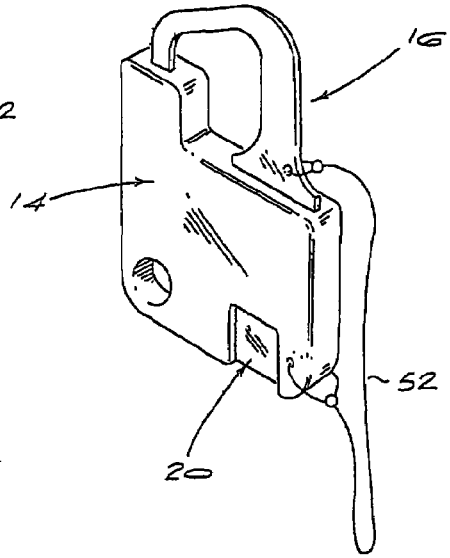
FIG. 2 illustrates the same padlock and combination in a locked condition.
Figure 3:
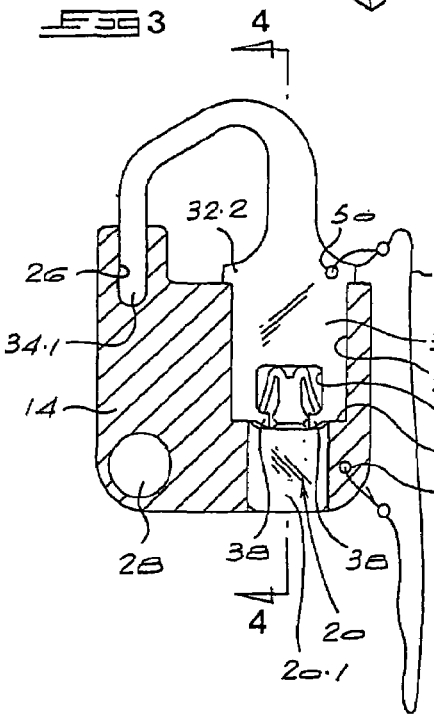
FIG. 3 shows a cross-sectional view of the padlock combination of FIG. 1 in the locked condition.

In order to close the padlock, the hasp 16 is aligned with the lock body 14 as shown in FIG. 1. The hasp and lock body are then moved relative to one another so that the legs 32 and 34 enter and slide into the passage 22 and opening 26 respectively. When the hasp is fully inserted the end 34.1 of the leg 34 abuts the blind end of the opening 26, the shoulders 32.2 on the hasp abut the mouth of the passage at the open end 23 and the end of the leg 32 abuts the shoulder 24, as shown in FIG. 2.

In order to seal the lock the seal 20 is positioned in the recess 27 and is slid, in direction opposite to that in which the hasp is inserted, into the opposite end 25 of the passage 22. When the arms 20.4 of the insertion portion 20.2 encounter the tabs 38 they are inwardly deflected. When the insertion portion is fully inserted the arms move past the tabs and thereafter, with the insertion portion fully located in the cavity 36, spring back to locate behind the tabs, i.e. the extremities of the legs 20.4 of the insertion portion 20.2 locate behind the tabs 38.

The insertion portion is accordingly clipped into the cavity 36 in the passage 22, with the tab portion 20.1 lying flat in the recess 27. It will be understood that the seal cannot be withdrawn by a sliding action, because this would merely draw the extremities of the legs 20.4 against the inner inclined surfaces 38.2 of the tabs 38. Thus, with the insertion portion 20.2 of the seal clipped into the cavity 36 inside the passage 22, the hasp is effectively locked to the lock body. In order to open the padlock, it is necessary to break the seal 20.

Figure 4:
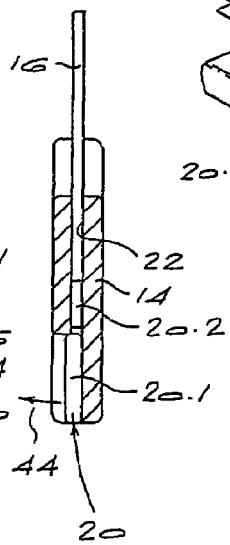
FIG. 4 shows a cross-section at the line 4—4 in FIG. 3.

This is achieved by bending the tab 20.1 in a direction out of the recess 27, as indicated in FIG. 4 by the arrow 44, so that the seal breaks at a zone of reduced thickness 20.5 between the tab and insertion portions. Once the tab has been broken off, the hasp can be withdrawn from the lock body and the insertion portion can be removed from the cavity 36.

Figure 5:
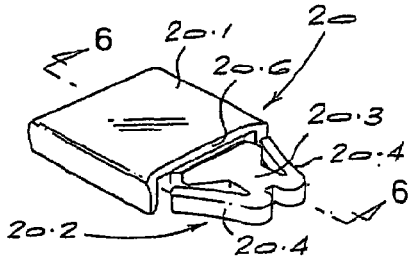
FIG. 5 shows a perspective view of the seal of the padlock combination of FIG. 1.
Figure 6:
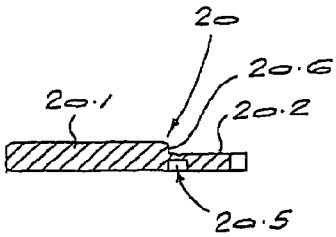
FIG. 6 shows a cross-section at the line 6—6 in FIG. 5.

Referring to FIGS. 5 and 6 it will be seen that the tab 20.1 forms a recessed, upstanding wall 20.6 adjacent the root of the stem 20.3. When the insertion portion 20.2 of the seal is clipped into the cavity 36, the wall recess receives portions of the tabs 38 so that the wall lies closely adjacent those tabs. With this feature it is difficult if not impossible to insert a sharp tool past the tab 20.1 and into the passage 22 in order to unclip the insertion portion 20.2 from the cavity 36, thereby improving the integrity of the seal.

In an application of the padlock and padlock combination to, for instance, an airline trolley, the hasp will be arranged in the normal way to pass through openings in the components of the trolley which are to be locked to one another, eg the frame of the trolley and a door or drawer. It will also be understood that in such applications, a visual inspection of the seal to ensure that it is not broken provides an assurance that the trolley has not been opened without authorisation prior to being brought onto the aircraft.

The large hole 28 provides a suspension point at which the padlock, once unlocked, can be suspended from a hook or the like for re-use at a later stage with a new seal 20.

The hasp 16 is formed with a small hole 50. This hole and the small hole 30 in the lock body provide attachment points for the ends of a thin cord 52 which serves to attach the hasp to the lock body, to prevent inadvertant loss of the hasp.

Figure 7:
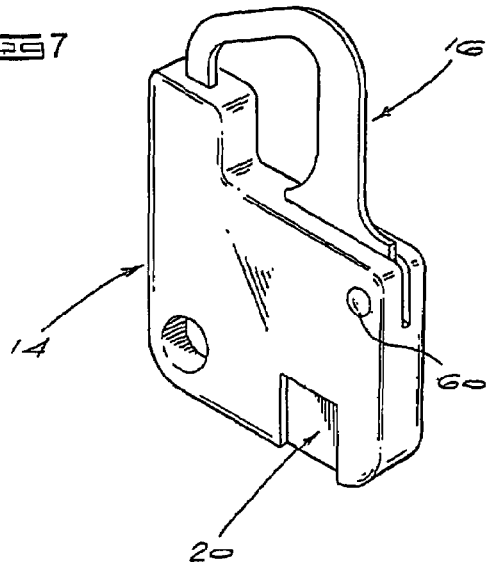
FIG. 7 shows a perspective view of a padlock combination according to a second embodiment of the invention in a locked condition.
Figure 8:
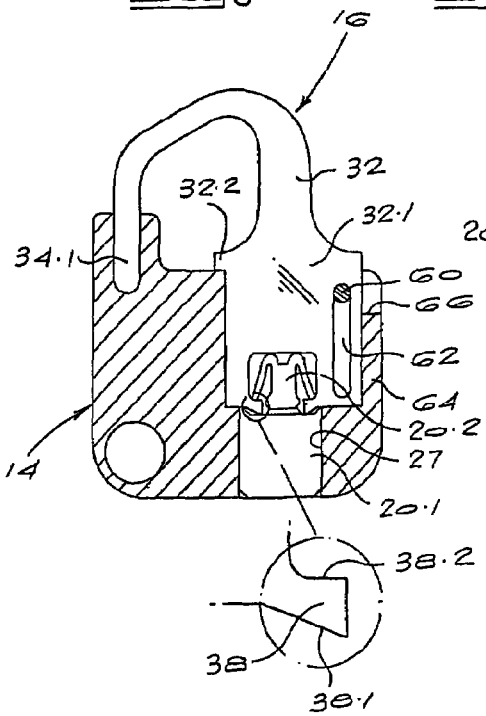
FIG. 8 shows a cross-sectional view of the second embodiment.
Figure 9:
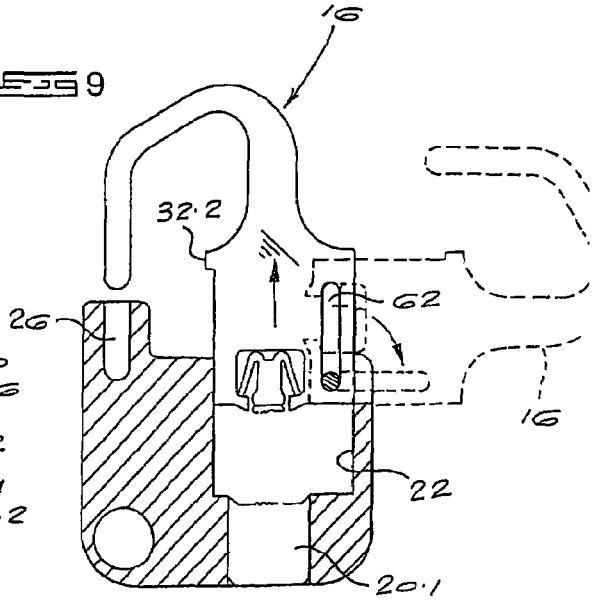
FIG. 9 shows, in a cross-sectional view, the movement of the hasp in a cross-sectional view.

FIGS. 7 to 9 illustrate a second embodiment of the invention which does away with the need for a cord 52 to attach the hasp to the lock body. In these Figures, components corresponding to those illustrated in FIGS. 1 to 6 are indicated with the same reference numerals.

In this embodiment, the hasp 16 is permanently attached, in a manner allowing both sliding and pivotal movement, to the lock body 14. This is achieved by means of a rivet 60 which passes through the lock body, in the passage 22, and through an elongate slot 62 in the end 32.1 of the leg 32 of the hasp. It will also be noted that the side 64 of the lock body is laterally extended and provides a shoulder 66 adjacent the rivet 60, and that there is only a single shoulder 32.2.

FIGS. 7 and 8 show the second embodiment in a closed and locked condition. As in the first embodiment, the legs 32.1 and 32.2 are located in the passage 22 and blind opening 26, and the insertion portion 20.2 of the seal 20 is clipped into the cavity 36, inside the passage 22, with the tab portion 20.1 of the seal lying flat in the recess 27. As before it will be understood that the hasp is effectively locked to the lock body by the seal when the padlock combination is in this locked condition.

It will also be noted that in the locked position, the rivet 60 is situated at the outer end of the slot 62.

In order to open the padlock, the seal 20 is broken by bending the tab portion 20.1 in a direction out of the recess. Once the tab portion has been broken away from the insertion portion, the hasp can be slid outwardly as shown in full lines in FIG. 9. The rivet 60 slides along the slot 62 to its inner end as illustrated. At this stage the insertion portion 20.2 of the seal is still retained in the cavity 36. When the rivet has reached the end of its travel in the slot, the hasp can be pivoted to the broken line position in FIG. 9, allowing the insertion portion 20.2 of the seal to fall out of, or be removed from, the cavity 36. Abutment of the side of the hasp with the shoulder 66 prevents further pivotal movement of the hasp.

In order to re-lock the padlock, the opposite procedure is followed, i.e. the hasp is pivoted to the full line position in FIG. 9 and is then slid inwardly to the FIG. 8 position, whereafter a fresh seal 20 can be clipped into place.

In both embodiments, the inclination of the tabs 38 is a security feature. The tabs and the upstanding wall 20.6 of the seal 20 are so designed that the tabs extend into the recess as will be apparent from FIGS. 2 and 7. The tabs accordingly provide some security against insertion of a sharp tool into the passage 22 with the intention of unclipping the legs 20.4 of the seal.

The invention claimed is:

1. A padlock comprising:

a moulded plastics lock body having therein an open-ended passage and an opening spaced from the passage; and a hasp which has first and second spaced apart legs, an end of the first leg being locatable in the passage through a first end thereof and an end of the second leg being locatable simultaneously in the opening, the end of the first leg in the passage being engagable by a breakable seal inserted into the passage through an opposite, second end thereof to lock the hasp relative to the lock body, wherein the opening in which the end of the second leg of the hasp is locatable is a blind opening in the lock body.

2. A padlock according to claim 1 wherein the lock body is of one-piece, moulded plastics construction.

3. A padlock according to claim 2 wherein the lock body has a thickness of 8 mm or less.

4. A padlock according to claim 1 wherein the hasp is attached to the lock body by a cord.

5. A padlock according to claim 1 wherein the hasp is made of steel.

6. A padlock comprising:

a moulded plastics lock body having therein an open-ended passage and an opening spaced from the passage; and a hasp which has first and second spaced apart legs, an end of the first leg being locatable in the passage through a first end thereof and an end of the second leg being locatable simultaneously in the opening, the end of the first leg in the passage being engagable by a breakable seal inserted into the passage through an opposite, second end thereof to lock the hasp relative to the lock body, the hasp being attached to the lock body by a transverse rivet which engages the lock body and passes through a slot in the hasp, thereby allowing sliding and pivotal movement of the hasp relative to the lock body.

7. A padlock comprising:

a moulded plastics lock body having therein an open-ended passage and an opening spaced from the passage; and a hasp which has first and second spaced apart legs, an end of the first leg being locatable in the passage through a first end thereof and an end of the second leg being locatable simultaneously in the opening, the end of the first leg in the passage being engagable by a breakable seal inserted into the passage through an opposite, second end thereof to lock the hasp relative to the lock body, the first leg of the hasp body having a cavity therein which is located in the passage when the end of this leg is located in the passage and into which an insertion portion of the seal is clipped in use in order to lock the hasp relative to the lock body; wherein the opening in which the end of the second leg of the hasp is locatable is a blind opening in the lock body.

8. A padlock according to claim 7 wherein the lock body has a recess therein into which the second end of the passage opens, the recess being arranged to accommodate a tab portion of the seal when the insertion portion thereof is clipped into the cavity.

9. A padlock according to claim 7 wherein the cavity is defined partly by a pair of opposing, inclined tabs at the end of the first leg of the hasp.

10. A padlock combination comprising a padlock and a breakable seal, the padlock including a moulded plastics lock body having therein an open-ended passage and an opening spaced from the passage and a hasp which has first and second spaced apart legs, an end of the first leg being locatable in the passage through a first end thereof and an end of the second leg being locatable simultaneously in the opening, and the seal having an insertion portion which can be engaged, by movement of the seal through the second end of the passage, with the end of the first leg of the hasp when this end is located in the passage, thereby to lock the hasp relative to the lock body, the insertion portion of the seal being shaped to clip into a cavity in the end of the first leg of the hasp; the breakable seal has a tab portion connected at a breakable connection to the insertion portion, the tab portion being arranged to be located in a recess in the lock body, into which the second end of the passage opens, when the insertion portion of the seal is clipped into the cavity; wherein the cavity in the end of the first leg of the hasp is defined partly by a pair of opposing, inclined tabs and the tab portion of the seal includes an upstanding wall which is recessed to receive the tabs when the insertion portion of the seal is clipped into the cavity.

* * * * *